United States Patent [19]

Dozono

[11] 4,409,936

[45] Oct. 18, 1983

[54] SPLIT TYPE INTERNAL COMBUSTION ENGINE

[75] Inventor: Kichihiko Dozono, Yokosuka, Japan

[73] Assignee: Nissan Motor Company, Limited, Yokohama, Japan

[21] Appl. No.: 241,033

[22] Filed: Mar. 6, 1981

[30] Foreign Application Priority Data

Mar. 7, 1980 [JP] Japan ..... 55-28879

[51] Int. Cl.[3] ..... F02D 17/02

[52] U.S. Cl. ..... 123/198 F; 123/481

[58] Field of Search ..... 123/198 F, 481

[56] References Cited

U.S. PATENT DOCUMENTS 4,040,395 8/1977 Demetrescu ..... 123/481

OTHER PUBLICATIONS

Bates et al, "Variable Displacement by Engine Valve Control", 1978 article from the Society of Automotive Engineers (SAE).

*Primary Examiner*—Tony M. Argenbright

*Attorney, Agent, or Firm*—Schwartz, Jeffery, Schwaab, Mack, Blumenthal & Koch

[57] ABSTRACT

An internal combustion engine is disclosed which comprises first and second cylinder units each including at least one cylinder, sensor means for providing a signal indicative of engine vibration, and control means for disabling the first cylinder unit when the engine load is below a predetermined value. The control means is adapted to hold the first cylinder unit active, regardless of engine load conditions, when the engine vibration indicative signal exceeds a predetermined value indicative unstable engine operation.

2 Claims, 2 Drawing Figures

SPLIT TYPE INTERNAL COMBUSTION ENGINE

BACKGROUND OF THE INVENTION

1. Field of the Invention

This invention relates to improvements in an internal combustion engine of the split type operable on less than all of its cylinders when the engine load is below a given value.

2. Description of the Prior Art

As is known it is desirable to increase the efficiency of a multicylinder internal combustion engine by reducing the number of cylinders on which the engine operates under predetermined engine operating conditions, particularly conditions of low engine load. For this purpose, control means are provided which disables a number of cylinders in a multicylinder internal combustion engine by suppressing the supply of fuel to certain cylinders or by preventing the operation of the intake and exhaust valves of selected cylinders under low load conditions. The disablement of some of the cylinders of the engine increases the load on those remaining in operation and, as a result, the energy conversion efficiency is increased.

One difficulty with such split type internal combustion engine is the tendency toward unstable engine operation and increased engine vibration during a split engine mode where the engine operates only on selected cylinders and the interval between which explosion occur becomes larger. This is true particularly at low engine speed conditions.

In order to achieve stable engine operation and suppress engine vibration, attempts have been made to maintain engine operation in a full engine mode (where the engine operates all of the cylinders), regardless of engine load conditions, whenever the engine speed is below a predetermined value. However, such operation results in a fuel economy penalty since ,he engine is held in a full engine mode of operation at low engine speed conditions, regardless of the actual occurrence of unstable engine operation.

The present invention provides an improved split type internal combustion engine wherein engine operation to changes into a full engine mode, regardless of engine load conditions, whenever the engine vibration level exceeds a value indicating unstable engine operation.

SUMMARY OF THE INVENTION

The present invention provides an internal combustion engine which comprises first and second cylinder units each including at least one cylinder, and control means responsive to engine load conditions for disabling the first cylinder unit when the engine load is below a predetermined value. Sensor means is provided for generating a signal indicative of engine vibration. The control means are adapted to hold the first cylinder unit active, regardless of engine load conditions, when the engine vibration indicative signal exceeds a predetermined value causing unstable engine operation.

Preferably, the control means is constructed to change the predetermined value to a high value for a predetermined time after the engine vibration indicative signal exceeds the predetermined value, and to hold the first cylinder unit active for a predetermined time after the engine vibration indicative signal exceeds the predetermined value. This is effective to avoid control-hunting.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENT

Figure 1:
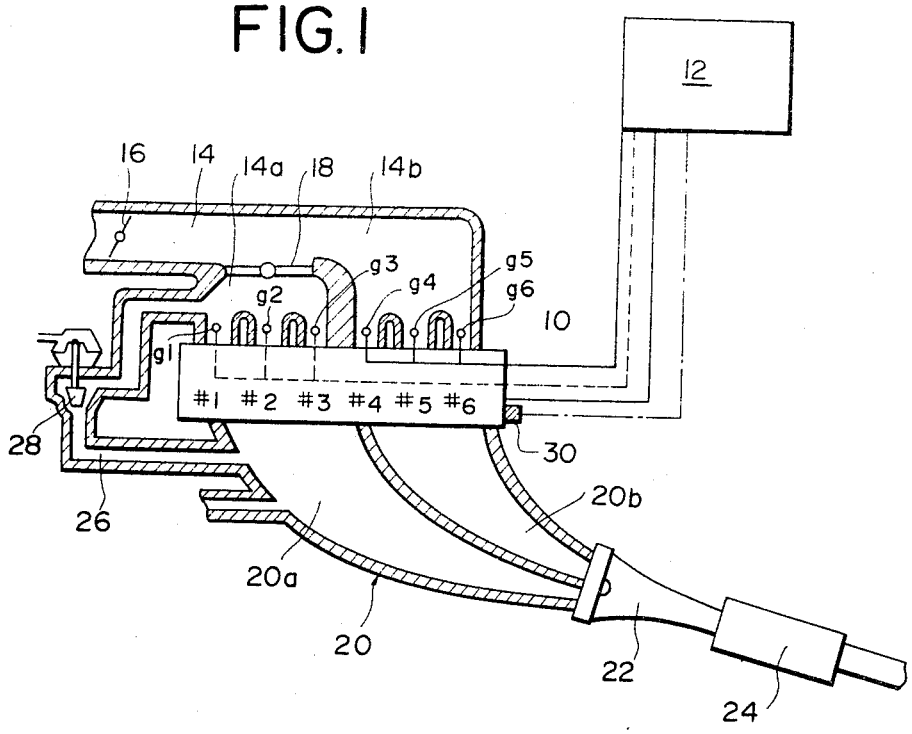
FIG. 1 is a schematic sectional view showing one embodiment of a split type internal combustion engine made in accordance with the present invention.

Referring now to FIG. 1, there is illustrated one embodiment of a split type internal combustion engine made in accordance with the present invention. The engine comprises an engine block 10 which contains an inactive cylinder unit including three cylinders #1 to #3 which are inactive when the engine load is below a predetermined value and an active cylinder unit including three cylinders #4 to #6 which are always active during engine operation. Fuel is supplied through fuel injection valves g1 to g3 into the respective cylinders #1 to #6.

Reference numeral 12 designates a control circuit which provides, in synchronism with engine speed, a fuel-injection pulse signal proportional to the intake airflow rate sensed by an airflow meter (not shown) and corrected in accordance with the air/fuel ratio sensed by and air/fuel ratio sensor (not shown). The fuel-injection pulse signal is applied to the fuel injection valves g1 to g6 which thereby supply a controlled amount of fuel to the associated cylinders #1 to #6. When the engine load falls below a predetermined value, the control circuit 12 interrupts the supply of the fuel-injection pulse signal to the fuel injection valves g1 to g3 to disable the cylinders #1 to #3, whereby the engine operation is changed from its full engine mode into a split engine mode where the engine operates only on remaining cylinders #3 to #6.

Air is introduced to the engine through an air induction passage 14 provided therein with a throttle valve 16 drivingly connected to the accelerator pedal (not shown) for controlling the flow of air to the engine. The induction passage 14 is divided downstream of the throttle valve 16 into first and second intake passages 14*a* and 14*b*. The first intake passage 14*a* leads to cylinders #1 to #3, and the second intake passage 14*b* leads to cylinders #4 to #6. The first intake passage 14*a* is provided at its entrance with a stop valve 18 which is normally in its open position to permit the flow of fresh air into the cylinders #1 to #3. The stop valve 18 closes to block the supply of fresh air to the cylinders #1 to #3 during split engine mode of operation.

The engine also has an exhaust manifold 20 which is divided into first and second exhaust passages 20*a* and 20*b*. The first exhaust passage 20*a* leads from the cylinders #1 to #3, and the second exhaust passage 20*b* leads from the cylinders #4 to #6. The exhaust manifold 20 is connected at its downstream end to an exhaust duct 22. The exhaust duct 22 has therein an exhaust gas purifier 24 for minimizing the emission of pollutants through the exhaust duct 22.

An exhaust gas recirculation (EGR) passage 26 is provided which has one end opening into the first exhaust passage 20*a* and the other end thereof opening into the first intake passage 14*a*. The EGR passage 26 has therein an EGR valve 28 which opens to permit recirculation of exhaust gases from the first exhaust passage 20*a* into the first intake passage 14*a* so as to minimize pumping losses in the inactive cylinders #1 to #3 during split engine mode of operation. The EGR valve 28 closes to prevent exhaust gas recirculation during a full engine mode of operation.

A vibration sensor 30 is provided on one side of the engine block 10. The vibration sensor 30 provides, to the control circuit 12, a signal indicative of the vibration level appearing on the engine block 10, as shown in wave form 30*a* of FIG. 2. When the vibration level exceeds a predetermined value A (FIG. 2), which may be selected to be a minimum value indicating unstable engine operation, during a split engine mode of operation (SEM), the control circuit 12 changes the engine operation into a full engine mode (FEM) by resuming the supply of the fuel-injection pulse signal to the fuel injection valves g1 to g3, closing the EGR valve 28, and opening the stop valve 18.

Figure 2:
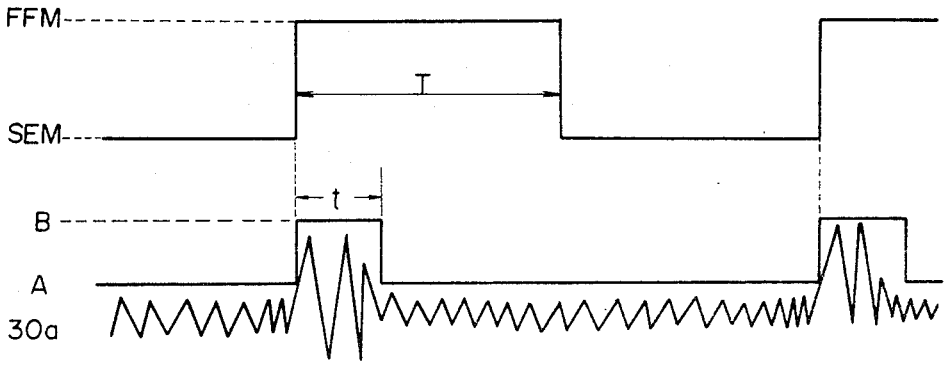
FIG. 2 is a diagram showing engine operation mode changes in connection with the output of the vibration sensor used in the engine of FIG. 1.

In order to avoid control-hunting, the control circuit 12 changes the predetermined value A to a higher value B (FIG. 2) for a suitable time t after the engine mode is changed to its full engine mode, and also holds the changed full engine mode for a predetermined time T, as shown in FIG. 2.

With the arrangement of the present invention, the engine operation changes into a full engine mode, regardless of engine load conditions, when the engine vibration level exceeds a value indicating unstable engine operation. Accordingly, the range in which the engine is permitted to operate in its split engine mode becomes wider and fuel economy becomes higher as compared to conventional split type internal combustion engines.

While the present invention has been described in connection with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) first and second cylinder units each including at least one cylinder;

(b) sensor means sensitive to engine vibrations for providing a signal indicative of a sensed vibration level; and (c) control means responsive to engine load conditions for disabling said first cylinder unit at low load conditions, said control means being responsive to the signal from said sensor means for holding said first cylinder unit active, regardless of engine load conditions, when the sensed vibration level exceeds a reference value, said control means being operable to increase the vibration reference value by a predetermined value for a first predetermined time after the sensed vibration level exceeds the reference value and to hold the first cylinder unit active for a second predetermined time after the sensed vibration level exceeds the reference level.

2. An internal combustion engine comprising:

(a) first and second cylinder units each including at least one cylinder;

(b) sensor means sensitive to engine vibrations for providing a signal indicative of a sensed vibration level; and (c) control means responsive to engine load conditions for disabling said first cylinder unit at low load conditions, said control means being responsive to the signal from said sensor means for holding said first cylinder unit fully active, regardless of engine load conditions, when the sensed vibration level exceeds a reference value indicative of unstable engine operation, said control means being operable to increase the vibration reference value by a predetermined value for a first predetermined time after the sensed vibration level exceeds the reference value and to hold the first cylinder unit active for a second predetermined time after the sensed vibration level exceeds the reference value.

* * * * *